US010843269B2

(12) United States Patent
Shinohara et al.

(10) Patent No.: US 10,843,269 B2
(45) Date of Patent: Nov. 24, 2020

(54) METHOD OF PRODUCING SINTERED AND FORGED MEMBER

(71) Applicant: TOYOTA JIDOSHA KABUSHIKI KAISHA, Toyota (JP)

(72) Inventors: Nobuyuki Shinohara, Tajimi (JP); Kimihiko Ando, Toyota (JP); Toshiyuki Kosai, Kariya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 196 days.

(21) Appl. No.: 15/974,986

(22) Filed: May 9, 2018

(65) Prior Publication Data

US 2018/0326490 A1 Nov. 15, 2018

(30) Foreign Application Priority Data

May 15, 2017 (JP) ..... 2017-096735

(51) Int. Cl.
*B22F 3/17* (2006.01)
*B22F 3/16* (2006.01)
(Continued)

(52) U.S. Cl.
CPC ..... *B22F 3/17* (2013.01); *B22F 3/16* (2013.01); *C22C 22/00* (2013.01);
(Continued)

(58) Field of Classification Search
CPC ..... B22F 1/0003; B22F 1/0059; B22F 1/007; B22F 3/1003–1007; B22F 3/1035;
(Continued)

(56) References Cited

U.S. PATENT DOCUMENTS

2008/0025866 A1* 1/2008 Kondoh ..... C22C 33/0264 420/100
2010/0116088 A1* 5/2010 Sato ..... C22C 1/1084 75/243
2011/0206551 A1* 8/2011 Kondoh ..... B22F 3/1007 419/15

FOREIGN PATENT DOCUMENTS

JP 2007291467 A * 11/2007
JP 2010-111937 A 5/2010
(Continued)

OTHER PUBLICATIONS

Frick, John; "Woldman's Engineering Alloys (9th Edition)", ASM International 2010, (Year: 2010).*
(Continued)

*Primary Examiner* — Alexandra M Moore
*Assistant Examiner* — Austin Pollock
(74) *Attorney, Agent, or Firm* — Oliff PLC

(57) ABSTRACT

A method of producing a sintered and forged member includes a mixing process in which a manganese-containing powder made of Fe—Mn—C—Si containing manganese as a main component, an iron powder made of Fe, a copper powder made of Cu, and a graphite powder made of graphite are mixed together to prepare a mixed powder; a molding process in which the mixed powder is compression-molded into a molded product; a sintering process in which, when the molded product is heated, copper derived from the copper powder and manganese contained in the manganese-containing powder are alloyed, the alloyed copper-manganese alloy is brought into a liquid phase state, and the molded product is sintered to produce a sintered product while elements of the copper-manganese alloy diffuse into an iron base of the molded product; and a process in which the sintered product is forged.

14 Claims, 4 Drawing Sheets

(51) Int. Cl.

| | |
|---|---|
| ***C22C 38/16*** | (2006.01) |
| ***C22C 33/02*** | (2006.01) |
| ***C22C 38/02*** | (2006.01) |
| ***C22C 38/04*** | (2006.01) |
| ***C22C 22/00*** | (2006.01) |

(52) U.S. Cl.
CPC ..... *C22C 33/0207* (2013.01); *C22C 33/0264* (2013.01); *C22C 38/02* (2013.01); *C22C 38/04* (2013.01); *C22C 38/16* (2013.01); *B22F 2301/10* (2013.01); *B22F 2301/35* (2013.01); *B22F 2302/40* (2013.01); *B22F 2302/45* (2013.01); *B22F 2998/10* (2013.01); *B22F 2999/00* (2013.01)

(58) Field of Classification Search
CPC ..... B22F 3/16–162; B22F 2301/10; B22F 2301/35; B22F 2301/40; B22F 2302/40; B22F 2302/45; B22F 2998/00–10; B22F 2999/00; C22C 22/00; C22C 33/006; C22C 33/02–0207; C22C 33/0257; C22C 33/0264; C22C 35/00–005; C22C 38/02–04; C22C 38/16
See application file for complete search history.

(56) References Cited

FOREIGN PATENT DOCUMENTS

| | | |
|---|---|---|
| JP | 2010-133016 A | 6/2010 |
| JP | 2013-167006 A | 8/2013 |
| JP | 2014-122396 A | 7/2014 |

OTHER PUBLICATIONS

James, Brian; "Powder Forging", Review in Particulate Materials, vol. 2, p. 173-214, 1994 (Year: 1994).*
Singh Ramesh; "Applied Welding Engineering"; Processes, Codes, and Standards, 2nd edition, 2016 (Year: 2016).*
Retelsdorf H, "Base Alloying Powders for Production of Sintered Alloy Steel", J. Metall, 1975, p. 1002-1006, vol. 29, Issue 10 (Year: 1975).*
Dec. 26, 2019 Translation of Office Action issued in Chinese Patent Application No. 201810455465.4.
Liu, C., et al. New Hardware Manual. Henan Science and Technology Press, Oct. 1999, p. 59 (with title pages).
Cao, D. Powder Metallurgy Material. Metallurgical Industry Press, Nov. 1989, pp. 5 and 8 (with title pages).

* cited by examiner

METHOD OF PRODUCING SINTERED AND FORGED MEMBER

INCORPORATION BY REFERENCE

The disclosure of Japanese Patent Application No. 2017-096735 filed on May 15, 2017 including the specification, drawings and abstract is incorporated herein by reference in its entirety.

BACKGROUND

1. Technical Field

The present disclosure relates to a method of producing a sintered and forged member that is obtained by compression-molding a mixed powder in which powder such as an iron powder is mixed and then sintering and forging the mixed powder.

2. Description of Related Art

In internal combustion engines such as engines in vehicles and the like, sintered and forged members are used for components such as a connecting rod that connects a piston and a crankshaft. As such a sintered and forged member, for example, in Japanese Unexamined Patent Application Publication No. 2014-122396 (JP 2014-122396 A), a method of producing a sintered and forged member that includes a mixing process in which a manganese powder, a copper powder, a graphite powder, a sulfur powder, and an iron powder are mixed together, a molding process in which the mixed powder is compression-molded into a powder magnetic core, a sintering process in which the molded product is sintered, and a forging process in which the sintered product is forged is proposed.

SUMMARY

However, in the sintered and forged member produced by the production method in JP 2014-122396 A, manganese does not sufficiently diffuse into an iron base, but segregates (monotectoid of manganese occurs). Thus, the yield ratio of the sintered and forged member decreases and the machinability of the sintered and forged member deteriorates.

The present disclosure provides a method of producing a sintered and forged member through which manganese sufficiently diffuses into an iron base, the yield ratio of the sintered and forged member increases and the machinability can be improved.

An aspect of the present disclosure is a method of producing a sintered and forged member which includes 0.10 mass % to 1.00 mass % C, 2.50 mass % to 5.00 mass % Cu, 0.50 mass % to 0.75 mass % Mn, and 0.02 mass % or less Si with the balance consisting of Fe and inevitable impurities with respect to the total mass and has a mass ratio of Mn/Cu in the range of 0.10 to 0.25 The production method includes at least a mixing process in which a manganese-containing powder made of Fe—Mn—C—Si containing manganese as a main component, an iron powder made of Fe, a copper powder made of Cu, and a graphite powder made of graphite are mixed together to prepare a mixed powder; a molding process in which the mixed powder is compression-molded into a molded product; a sintering process in which, when the molded product is heated, copper derived from the copper powder and manganese contained in the manganese-containing powder are alloyed to a copper-manganese alloy, and the alloyed copper-manganese alloy is brought into a liquid phase state, and the molded product is sintered to produce a sintered product while elements of the copper-manganese alloy diffuse into an iron base of the molded product; and a process in which the sintered product is forged.

According to the present disclosure, when the manganese-containing powder made of Fe—Mn—C—Si containing manganese as a main component is used, during sintering, it is possible to prevent oxidation of Mn by C and lower the viscosity of the manganese-containing powder by Si. Thus, since Mn of the manganese-containing powder can sufficiently diffuse into the iron base, it is possible to prevent segregation (monotectoid) of Mn, increase the yield ratio of the sintered and forged member in the sintered and forged member, and improve the machinability thereof.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
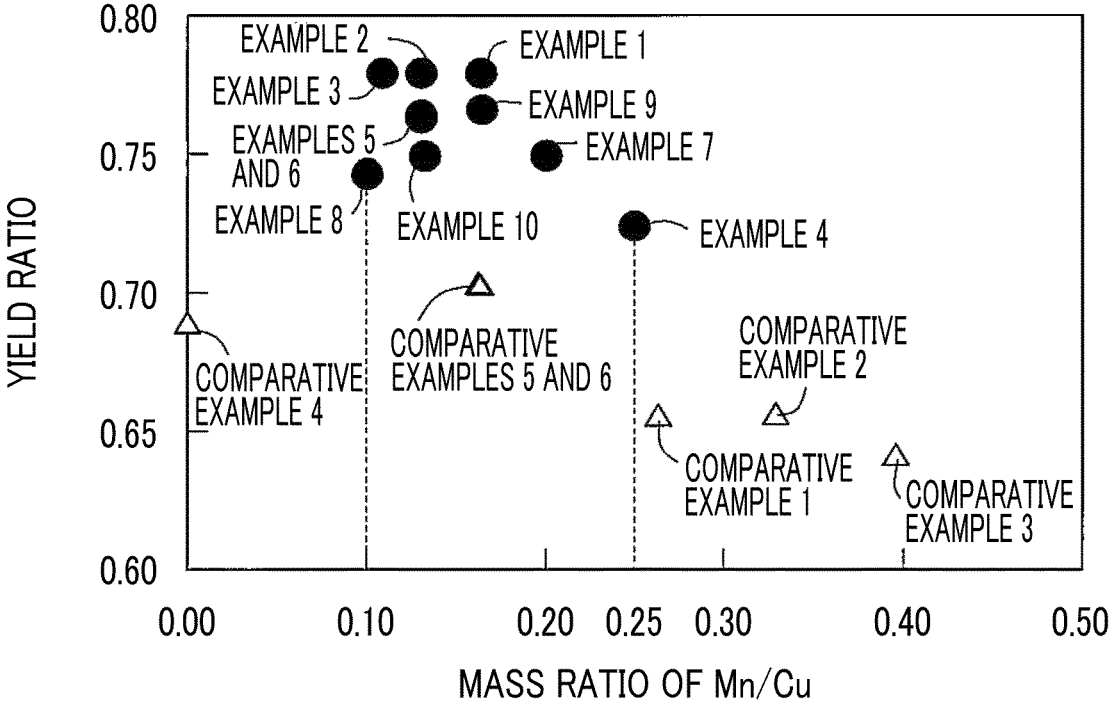
FIG. 1 is a graph showing the relationship between a mass ratio of Mn/Cu and a yield ratio of sintered and forged members according to Examples 1 to 10 and Comparative Examples 1 to 6.

A method of producing a sintered and forged member according to the present embodiment will be described below.

1. Mixing Process

First, a mixed powder which is a starting material of a sintered and forged member is prepared. Specifically, a manganese-containing powder is made of Fe—Mn—C—Si containing manganese as a main component, an iron powder made of Fe, a copper powder made of Cu, and a graphite powder made of graphite are prepared, and a mixed powder obtained by mixing these powders is prepared. Various raw material powders are uniformly mixed according to the mixing process, and a homogeneous sintered product (iron-based sintered material) can be stably obtained.

1-1. Iron Powder

The iron powder is a powder that is a base of the sintered and forged member to be produced. In the present embodiment, the iron powder is, for example, a powder made of pure iron, and can be produced from molten iron using, for example, a pulverization method, a water atomization method, or a gas atomization method. Preferably, iron powder particles have an average particle size of 70 μm to 100 μm. On the assumption that the manganese-containing powder, the copper powder, and the graphite powder are contained at predetermined proportions, the iron powder is the remaining proportion.

1-2. Copper Powder

The copper powder is alloyed with manganese of the manganese-containing powder during sintering, the alloyed copper-manganese alloy is brought into a liquid phase state, these elements diffuse into an iron base having a ferrite structure and a pearlite structure, and the sintered and forged member is reinforced in a solid-solution state. In the present embodiment, the copper powder is, for example, a powder made of pure copper, and is a powder containing copper and inevitable impurities. The copper powder can be produced by the same production method as the iron powder. Preferably, copper powder particles have an average particle size of 10 μm to 80 μm. The copper powder is added in an amount of 2.50 mass % to 5.00 mass % with respect to the total mass of the mixed powder. Therefore, Cu with the same proportion can be contained in the entire sintered and forged member (total mass).

When an amount of copper powder added to the entire mixed powder is less than 2.50 mass %, improvement in machinability (yield ratio) of the sintered and forged member is not sufficient. In addition, when an amount of copper powder added exceeds 5.00 mass %, since there is excess Cu, Cu that does not diffuse into the iron base may precipitate on the sintered and forged member. An amount of copper powder added to the total mass of the sintered and forged member is preferably 3.00 mass % to 4.50 mass %, and more preferably 3.50 mass % to 4.50 mass %.

1-3. Graphite Powder

Regarding the graphite powder, C which is a component of graphite diffuses into the iron base during sintering, and the iron base is transformed into a ferrite structure and a pearlite structure. The graphite powder may be a natural graphite powder or an artificial graphite powder or a mixed powder thereof as long as C of the graphite powder can diffuse into the iron base during sintering. Preferably, graphite powder particles have a particle size in the range of 1 μm to 45 μm. As preferable graphite, graphite powder (CPB-S commercially available from Nippon Graphite Industries, Co., Ltd. can be exemplified.

The graphite powder is added in an amount of 0.10 mass % to 1.00 mass % with respect to the entire mixed powder. Therefore, C with substantially the same proportion can be contained in the entire sintered and forged member (total mass). Here, when an amount of graphite powder added to the entire mixed powder is less than 0.10 mass %, proof stress of the sintered and forged member is not sufficient. In addition, even if an amount of graphite powder added exceeds 1.00 mass %, further improvement in proof stress of the sintered and forged member is not expected. In addition, as an amount of C increases, there are fewer ferrite structures of the iron base of the sintered and forged member, further diffusion of Mn and Cu into the ferrite structure is not expected, the tensile strength of the sintered and forged member increases, and the hardness with respect to the proof stress of the sintered and forged member increases. Therefore, the machinability of the sintered and forged member deteriorates. An amount of graphite powder added with respect to the total mass of the sintered and forged member is preferably 0.20 mass % to 0.90 mass %, and more preferably 0.40 mass % to 0.70 mass %.

1-4. Manganese-Containing Powder

Regarding the manganese-containing powder, manganese that is contained and copper of the copper powder are alloyed during sintering, the alloyed copper-manganese alloy is brought into a liquid phase state, these elements diffuse into an iron base having a ferrite structure and a pearlite structure, and the sintered and forged member is reinforced in a solid-solution state. The manganese-containing powder is made of Fe—Mn—C—Si containing manganese as a main component. In the present embodiment, Fe—Mn—C—Si may be an Fe—Mn—C—Si alloy in which such components are alloyed.

Preferably, Fe—Mn—C—Si includes 62 mass % to 85 mass % Mn, 0.4 mass % to 1.8 mass % C, and 0.2 mass % to 1.6 mass % Si with the balance consisting of Fe and inevitable impurities. In this specification, "inevitable impurities" refers to various elements that are inevitably incorporated when materials such as Fe—Mn—C—Si are produced, such as phosphorus and oxygen.

As described above, Mn constituting Fe—Mn—C—Si is an element that diffuses in a solid-solution state into the iron base having a ferrite structure and a pearlite structure. It is difficult to obtain Fe—Mn—C—Si whose Mn is outside the range as an ore.

When a content of Mn exceeds 85 mass %, since the viscosity increases, it is difficult to produce a manganese-containing powder from the ore. In addition, since the viscosity of the manganese-containing powder increases during sintering, Mn is less likely to diffuse sufficiently in Cu.

C constituting Fe—Mn—C—Si is an element that bonds to oxygen earlier than Mn during sintering, prevents oxidation of Mn, lowers the viscosity of the manganese-containing powder during sintering, and promotes diffusion of Mn. When a content of C constituting Fe—Mn—C—Si is less than 0.4 mass %, the above effect may not be sufficiently exhibited. On the other hand, when a content of C exceeds 1.8 mass %, the other effects cannot be expected.

Si constituting Fe—Mn—C—Si is an element that lowers the viscosity of the manganese-containing powder during sintering and promotes diffusion of Mn. When a content of Si constituting Fe—Mn—C—Si is less than 0.2 mass %, the above effect may not be sufficiently exhibited. On the other hand, when a content of Si exceeds 1.6 mass %, the other effects cannot be expected. Here, when the manganese-containing powder contains Si at 1.6 mass % or less, the entire sintered and forged member contains Si at 0.02 mass % or less.

Preferably, manganese-containing powder particles have a particle size of 75 μm or less. Within such a particle size range, it is possible to diffuse manganese of the manganese-containing powder during sintering more appropriately.

In addition, on the assumption that components of the manganese-containing powder made of Fe—Mn—C—Si are within the above ranges, preferably, the manganese-containing powder is added in the range of 0.67 mass % to 0.88 mass % with respect to the entire mixed powder. As can be clearly understood from the results of Examples 1 to 10 to be described below, when such ranges are satisfied, it is possible to sufficiently exhibit functions of Mn, C, and Si.

1-5. Mass Ratio of Mn/Cu

In the present embodiment, the manganese-containing powder and the copper powder are added so that a mass ratio of manganese/copper contained in the sintered and forged member to be produced is in the range of 0.10 to 0.25. As can be clearly understood from examples to be described below, the sintered and forged member obtained using the mixed powder in which such a range is satisfied has higher machinability (yield ratio) than in the related art.

Here, when a mass ratio of Mn/Cu is less than 0.10, since an amount of manganese contained in the sintered and forged member is smaller, improvement in mechanical strength of the obtained sintered and forged member cannot be expected. On the other hand, when a mass ratio of Mn/Cu exceeds 0.25, since a content of manganese increases, a melting point of the copper-manganese alloy increases, and it is difficult to put the alloy into a liquid phase during sintering. Thus, diffusion of Mn and Cu becomes insufficient, and the yield ratio of the sintered and forged member decreases.

1-6. Other Powders

The mixed powder may contain the above manganese-containing powder, iron powder, copper powder, and graphite powder, and may contain another powder at about several mass % provided that the mechanical strength and wear resistance of the obtained sintered alloy do not deteriorate. In this case, when the total amount of the manganese-containing powder, the iron powder, the copper powder, and the graphite powder with respect to the mixed powder is 95 mass % or more, the effect can be sufficiently expected. For example, at least one machinability improving agent (powder) selected from the group consisting of a sulfide (for example, MnS), an oxide (for example, $CaCO_3$), a fluoride (for example, CaF), a nitride (for example, BN), and an oxysulfide may be additionally added to the mixed powder.

2. Molding Process

The obtained mixed powder is compression-molded into a molded product using a mold for molding. Before the mixed powder is filled into the mold, a higher fatty acid-based lubricant may be applied to an inner surface of the mold. The higher fatty acid-based lubricant used here may be a higher fatty acid metal salt in addition to a higher fatty acid itself. During application, a higher fatty acid-based lubricant dispersed in water, an aqueous solution, an alcohol solution or the like is sprayed in the heated mold.

Next, the mixed powder is filled into the mold having the inner surface to which the higher fatty acid-based lubricant is applied, and the filled mixed powder is pressure-molded (compression-molded) at room temperature. Here, in order to increase the density of the iron-based sintered material, the molded product may be molded by a warm mold lubrication method, and the present disclosure is not particularly limited to the method as long as the mixed powder can be formed into a desired shape with a desired density. When the mixed powder is pressure-molded, a device that is generally used in the technical field such as a pressure molding machine can be used. In this case, a pressure during pressure-molding preferably has an average surface pressure in the range of 3 t/cm$^2$ to 5 t/cm$^2$. When pressure-molding is performed in the above pressure range, it is possible to obtain a sintered and forged member having a desired strength and machinability.

3. Sintering Process

The obtained molded product is heated and sintered, for example, under an inert gas atmosphere such as that of an endothermic modified gas (RX gas), argon gas, or nitrogen gas. When the molded product is sintered under the RX gas atmosphere, decarburization can be prevented.

Specifically, when the molded product is heated, copper derived from the copper powder and manganese contained in the manganese powder are alloyed, and the alloyed copper-manganese alloy is brought into a liquid phase state and the molded product is sintered while elements of the copper-manganese alloy diffuse into the iron inside the molded product.

A sintering temperature and a sintering time are appropriately selected in consideration of desired characteristics, productivity, and the like of the sintered product. As the sintering temperature is higher, an iron-based sintered alloy (sintered product) with a higher strength can be obtained in a shorter time. In the present embodiment, the sintering temperature is within the range of 1100° C. to 1250° C. in order to put the copper-manganese alloy into a liquid phase and diffuse them. The sintering time is preferably set to be within the range of 0.1 hours to 3 hours in consideration of the sintering temperature, specifications of the sintered product (iron-based sintered alloy), productivity, cost, and the like.

Here, in the present embodiment, during sintering, C of the manganese-containing powder prevents oxidation of Mn, and Si of the manganese-containing powder lowers the viscosity of the powder. As a result, for example, compared to a case in which a manganese powder made of pure manganese is used, Mn is more likely to diffuse into the mixed powder (specifically, Cu powder) and a Cu—Mn alloy is more likely to be produced. The alloyed copper-manganese alloy melts and is brought into a liquid phase state, and copper and manganese easily diffuse into the iron base because the copper-manganese alloy is in a liquid phase state.

4. Forging Process

Next, the sintered product obtained in the sintering process is forged. Specifically, a predetermined forging pressure is applied to the sintered product. For example, the forging pressure has an average surface pressure in the range of 6 t/cm$^2$ to 8 t/cm$^2$. When the forging pressure with an average surface pressure of 6 t/cm$^2$ or more is applied, the density of the sintered and forged member obtained as a result can be 7.65 g/cm$^3$ or more. Therefore, when the sintered product is forged while the forging pressure in the above range is applied, it is possible to obtain a sintered and forged member having a desired strength and machinability.

In this process, a temperature at which the sintered product is forged is preferably in the range of 700° C. to 1100° C. Preferably, forging of the sintered product is completed within 10 seconds after the sintering process is completed. For example, in the sintering process, when the molded product is sintered using a sintering furnace, preferably, forging of the sintered product is completed within 10 seconds when the sintered product is removed from the sintering furnace. When the sintered product is forged under the above conditions, it is possible to prevent oxidation of the sintered and forged member.

In this process, an atmosphere in which the sintered product is forged is not particularly limited. For example, the forging is preferably performed in an air atmosphere or a gas atmosphere such as that of an endothermic modified gas (RX gas) or nitrogen gas ($N_2$ gas). When the sintered product is forged under the above atmosphere, it is possible to prevent oxidation of the sintered and forged member.

The sintered and forged member forged under the above conditions is preferably cooled to room temperature at a predetermined cooling rate. In this case, the cooling rate is preferably in the range of 90° C./min to 150° C./min. When the cooling rate is 90° C./min or more, the ferrite rate of the sintered and forged member obtained as a result can be set to a desired range. When the cooling rate is 150° C./min or less, it is possible to substantially prevent formation of the martensite structure. Therefore, it is possible to improve the machinability of the sintered and forged member obtained as a result.

Accordingly, it is possible to obtain a sintered and forged member which includes 0.10 mass % to 1.00 mass % C, 2.50 mass % to 5.00 mass % Cu, 0.50 mass % to 0.75 mass % Mn, and 0.02 mass % or less Si with the balance consisting of Fe and inevitable impurities with respect to the total mass, and has a mass ratio of Mn/Cu in the range of 0.10 to 0.25. The obtained sintered and forged member can be appropriately used as a member for a connecting rod and a gear.

In this manner, in the present embodiment, when the manganese-containing powder made of Fe—Mn—C—Si containing manganese as a main component is used, it is possible to accelerate diffusion of elements of the copper-manganese alloy into the base. Thus, as can be clearly understood from the following experiment performed by the inventors, it is possible to improve the machinability of the sintered and forged member.

Here, the machinability of the sintered and forged member according to the present embodiment can be evaluated using, for example, a yield ratio as an index. In this specification, "yield ratio" refers to a ratio of the proof stress to the tensile strength (proof stress/tensile strength). The proof stress and the tensile strength of the sintered and forged member can be measured based on, for example, JISZ 2241.

Examples in which the present disclosure is specifically implemented will be described below together with comparative examples.

Example 1

According to the following method, an iron-based sintered material of Example 1 was produced. As an iron powder made of pure iron, an atomized iron powder (model number ASC100.29 commercially available from Ipros Corporation) was prepared. A copper powder made of pure copper (Model number CE25 commercially available from Fukuda Metal Foil & Powder Co., Ltd.) was prepared. A graphite powder made of graphite (CPB-S commercially available from Nippon Graphite Industries, Co., Ltd.) was prepared. A manganese-containing powder (commercially available from Fukuda Metal Foil & Powder Co., Ltd.) made of Fe—Mn—C—Si containing manganese as a main component prepared by a crushing method was prepared. Fe—Mn—C—Si included Mn: 75 mass %, C: 1.5 mass %, and Si: 0.2 mass %, with the balance consisting of iron and inevitable impurities. Here, Table 1 shows components of manganese (Mn), carbon (C), and silicon (Si) of Fe—Mn—C—Si constituting manganese-containing powders of Example 1, Examples 2 to 10 to be described below, and Comparative Examples 1 to 3 to be described below, which are values measured using a high frequency induction heating furnace combustion-infrared absorption analyzing device, and a high frequency plasma (IPC) emission analyzing device.

The above copper powder at 3.00 mass %, manganese-containing powder at 0.67 mass %, and graphite powder at 0.40 mass %, and an iron powder as the balance (95.93 mass %) were prepared and these powders were mixed using a V type mixer for 30 minutes to obtain a mixed powder. A mold was used, and zinc stearate was applied to the inside of the mold. The mixed powder blended as described above was compression-molded at a pressure force of 4 ton/cm$^2$ to prepare a compression-molded product (molded product). Next, the obtained molded product was heated and sintered under an endothermic modified gas (RX gas) at 1150° C. for 20 minutes to produce a sintered product. Within 10 seconds after the sintered product was removed from a sintering furnace, forging was performed while applying a forging pressure with an average surface pressure of 7 ton/cm$^2$ under an air atmosphere. Thus, a sintered and forged member was obtained.

Examples 2 to 10

Sintered and forged members were produced in the same manner as in Example 1. Examples 2 to 10 differed from Example 1 in that, as shown in Table 1, components (compositions) of the manganese-containing powder and amounts of powders added to the mixed powder were different. Here, in all of the sintered and forged members of Examples 2 to 10, a content of manganese contained in the sintered and forged member was in the range of 0.50 mass % to 0.75 mass %, and the mass ratio of manganese/copper was in the range of 0.10 to 0.25.

Comparative Examples 1 to 3

Sintered and forged members were produced in the same manner as in Example 1. Comparative Examples 1 to 3 differed from Example 1 in that, as shown in Table 1, components (compositions) of the manganese-containing powder and amounts of powders added to the mixed powder were adjusted so that a content of manganese contained in the sintered and forged member exceeded 0.75 mass % and the mass ratio of manganese/copper exceeded 0.25 in all of the examples.

Comparative Example 4

A sintered and forged member was produced in the same manner as in Example 1. Comparative Example 4 differed from Example 1 in that no manganese-containing powder was added and amounts of powders added to the mixed powder were adjusted as shown in Table 1.

Comparative Example 5

A sintered and forged member was produced in the same manner as in Example 1. Comparative Example 5 differed from Example 1 in that a manganese powder made of pure manganese was used in place of the manganese-containing powder, and amounts of powders added to the mixed powder were adjusted as shown in Table 1.

Comparative Example 6

A sintered and forged member was produced in the same manner as in Example 1. Comparative Example 6 differed from Example 1 in that a manganese powder made of pure manganese was used in place of the manganese-containing powder, a small amount of Si powder was additionally added, and amounts of powders added to the mixed powder were adjusted as shown in Table 1.

TABLE 1

| | Mixed powder | | | | | | | | | | | | | | |
|---|---|---|---|---|---|---|---|---|---|---|---|---|---|---|---|
| | Manganese-containing powder | | | | Copper powder | Graphite powder | | | | | | | | | |
| | Amount added | Components (mass %) | | | Amount added | Amount added | Sintered and forged member (mass %) | | | | Yield | Tensile strength | Proof stress | Hardness | Density |
| | (mass %) | Mn | C | Si | (mass %) | (mass %) | Cu | Mn | C | Mn/Cu | ratio | (MPa) | (MPa) | (HV) | (g/cm$^3$) |
| Example 1 | 0.67 | 75 | 1.5 | 0.2 | 3.00 | 0.40 | 3.00 | 0.50 | 0.40 | 0.17 | 0.78 | 1035 | 803 | 336 | 7.84 |
| Example 2 | 0.71 | 70 | 1.6 | 0.5 | 3.75 | 0.40 | 3.75 | 0.50 | 0.40 | 0.13 | 0.78 | 1080 | 840 | 345 | 7.84 |
| Example 3 | 0.71 | 70 | 1.0 | 1.1 | 4.50 | 0.50 | 4.50 | 0.50 | 0.50 | 0.11 | 0.78 | 1239 | 907 | 378 | 7.86 |
| Example 4 | 0.88 | 85 | 1.4 | 1.6 | 3.00 | 0.70 | 3.00 | 0.75 | 0.70 | 0.25 | 0.72 | 1110 | 802 | 354 | 7.82 |
| Example 5 | 0.81 | 62 | 0.4 | 0.8 | 3.75 | 0.20 | 3.75 | 0.50 | 0.20 | 0.13 | 0.76 | 970 | 740 | 310 | 7.88 |
| Example 6 | 0.77 | 65 | 1.8 | 1.2 | 3.75 | 0.90 | 3.75 | 0.50 | 0.90 | 0.13 | 0.76 | 1268 | 961 | 407 | 7.88 |
| Example 7 | 0.71 | 70 | 1.0 | 1.2 | 2.50 | 0.20 | 2.50 | 0.50 | 0.20 | 0.20 | 0.75 | 859 | 640 | 272 | 7.77 |
| Example 8 | 0.74 | 68 | 0.5 | 0.5 | 5.00 | 0.50 | 5.00 | 0.50 | 0.50 | 0.10 | 0.74 | 1308 | 974 | 399 | 7.76 |
| Example 9 | 0.71 | 70 | 0.1 | 0.8 | 3.00 | 0.10 | 3.00 | 0.50 | 0.10 | 0.17 | 0.77 | 840 | 645 | 270 | 7.82 |
| Example 10 | 0.72 | 70 | 1.5 | 1.2 | 3.75 | 1.00 | 3.75 | 0.50 | 1.00 | 0.13 | 0.75 | 1333 | 1002 | 429 | 7.83 |
| Comparative Example 1 | 1.18 | 85 | 1.0 | 0.3 | 3.75 | 0.40 | 3.75 | 1.00 | 0.40 | 0.27 | 0.66 | 1307 | 830 | 375 | 7.80 |
| Comparative Example 2 | 1.45 | 86 | 1.5 | 0.3 | 3.75 | 0.40 | 3.75 | 1.25 | 0.40 | 0.33 | 0.66 | 1202 | 788 | 384 | 7.80 |
| Comparative Example 3 | 2.09 | 72 | 1.2 | 1.0 | 3.75 | 0.40 | 3.75 | 1.50 | 0.40 | 0.40 | 0.64 | 1266 | 812 | 405 | 7.80 |
| Comparative Example 4 | — | — | — | — | 3.00 | 0.55 | 3.00 | 0.00 | 0.55 | 0.00 | 0.69 | 888 | 610 | 276 | 7.84 |
| Comparative Example 5 | Pure Mn powder 5 mass % | | | | 3.00 | 0.55 | 3.00 | 0.50 | 0.55 | 0.17 | 0.70 | 981 | 688 | 295 | 7.84 |
| Comparative Example 6 | Pure Mn powder 5 mass % + small amount of Si powder | | | | 3.00 | 0.55 | 3.00 | 0.50 | 0.55 | 0.17 | 0.70 | 970 | 678 | 288 | 7.84 |

<Component Analysis>

Samples for measurement were cut out from the sintered and forged members of Examples 1 to 10, and Comparative Examples 1 to 6. C, Cu, and Mn contained in the obtained sample were analyzed using a high frequency induction heating furnace combustion-infrared absorption analyzing device and a high frequency plasma (IPC) emission analyzing device. The results are shown in Table 1. As shown in Table 1, since an amount of carbon contained in the manganese-containing powder was very small with respect to the entire mixed powder (sintered product), a proportion of the copper powder and a proportion of the graphite powder added to the entire mixed powder correspond to a proportion of copper (Cu) and a proportion of carbon (C), respectively, shown in components of the sintered and forged member shown in Table 1. In addition, as shown in Table 1, it can be understood that the sintered and forged members of Examples 1 to 10 satisfied C: 0.10 mass % to 1.00 mass %, Cu: 2.50 mass % to 5.00 mass %, and Mn: 0.50 mass % to 0.75 mass %.

Here, although a content of Si is not shown in Table 1, it was calculated from an amount of the manganese-containing powder added in the mixed powder shown in Table 1 and a content of Si contained therein, and among the sintered and forged members of Examples 1 to 10, Example 4 contained the largest amount of Si and a content of Si was 0.02 mass % with respect to the total mass (sum) of the sintered and forged member. Thus, the sintered and forged members of Examples 1 to 10 contained Si at 0.02 mass % or less.

Here, similarly, the sintered and forged member of Example 1 contained the smallest amount of Si, and a content of Si was 0.001 mass % with respect to the total mass (sum) of the sintered and forged member. Thus, the sintered and forged members of Examples 1 to 10 contained Si at 0.001 mass % or more.

<Hardness Test>

A hardness test (at room temperature) was performed on the sintered and forged members of Examples 1 to 10 and Comparative Examples 1 to 6 according to JIS Z 2244, and a Vickers hardness (condition of 10 kgf) was measured. The results are shown in Table 1. As shown in Table 1, in Examples 2, 5, 6, and 10, as an amount of carbon contained in the sintered and forged member increased, the hardness of the sintered and forged member increased.

<Density Measurement Test>

Samples with areas of 25 mm×25 mm were cut out from the sintered and forged members of Examples 1 to 10 and Comparative Examples 1 to 6. The weight of the cut samples was measured. The volume of the cut samples was measured according to the Archimedes' method. The density of the samples was calculated according to the measured weight and volume. The results are shown in Table 1. As shown in Table 1, the densities of the sintered and forged members of Examples 1 to 10 and Comparative Examples 1 to 6 were all similar.

<Tensile Strength and Proof Stress Measurement Test>

Samples with areas of 25 mm×25 mm were cut out from the sintered and forged members of Examples 1 to 10 and Comparative Examples 1 to 6. A tensile test was performed using a testing machine according to JIS B 7721 and a method according to JIS Z 2241, and the tensile strength and the proof stress were measured. Here, when the proof stress was measured, the 0.2% proof stress was set as a yield point at which plastic deformation of the sample started. A ratio of the proof stress to the tensile strength (proof stress/tensile strength) was calculated as the yield ratio. The results are shown in Table 1. Here, FIG. 1 to FIG. 5 to be described below show the relationships between components of the sintered and forged members of corresponding examples and comparative examples and the proof stress or the yield ratio.

<Structure Observation>

Figure 6A:
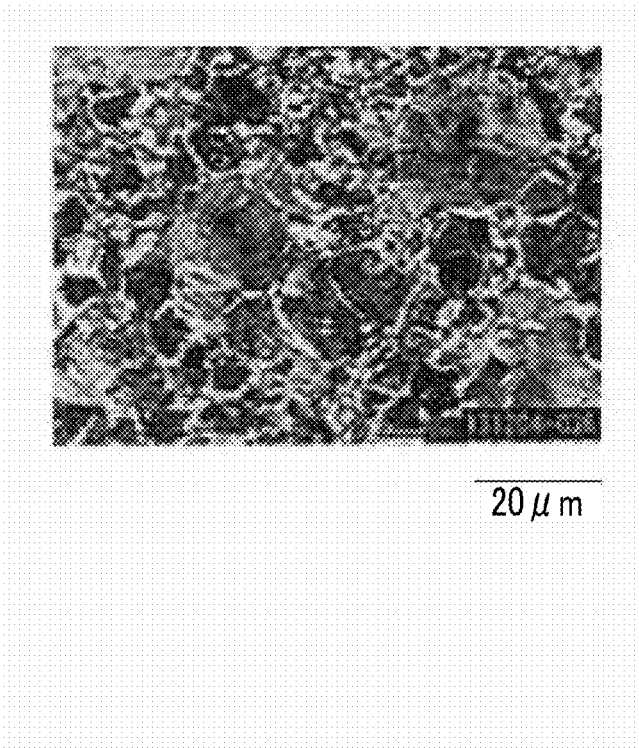
FIG. 6A is a structure picture of a sintered and forged member of Example 1.
Figure 6B:
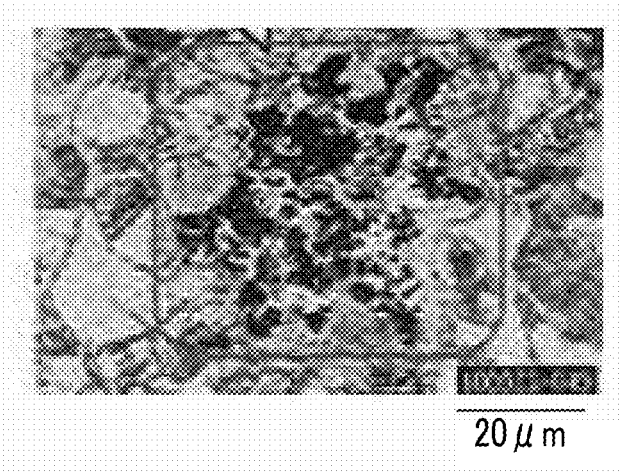
FIG. 6B is a structure picture of a sintered and forged member of Comparative Example 5.
Figure 6C:
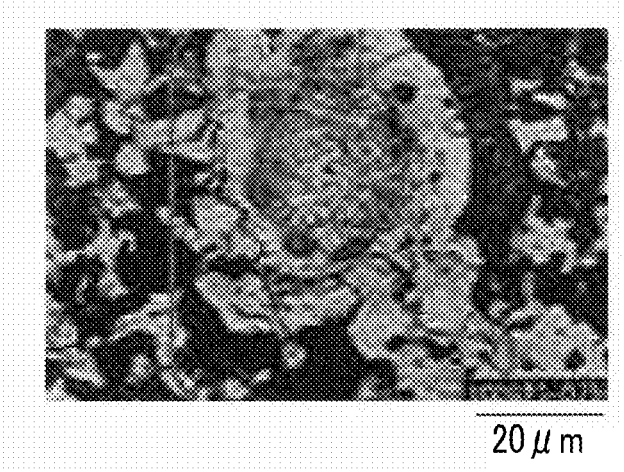
FIG. 6C is a structure picture of a sintered and forged member of Comparative Example 6.

Samples with areas of 15 mm×15 mm were cut out from the sintered and forged members of Example 1 and Comparative Examples 5 and 6. The cut samples were polished using abrasive paper and a buff. The cross section of the polished sample was etched using a nital solution. Then, the cross section of the etched sample was observed under an optical microscope. The results are shown in FIG. 6A to FIG. 6C. FIG. 6A is a structure picture of the sintered and forged member of Example 1. FIG. 6B is a structure picture of the sintered and forged member of Comparative Example 5. FIG. 6C is a structure picture of the sintered and forged member of Comparative Example 6.

FIG. 1 is a graph showing the relationship between the mass ratio of Mn/Cu and the yield ratio of the sintered and forged members according to Examples 1 to 10 and Comparative Examples 1 to 6. As shown in FIG. 1, the yield ratio of the sintered and forged members of Examples 1 to 10 was higher than that of Comparative Examples 1 to 3.

This is because, in the sintered and forged members of Examples 1 to 10, since Mn was more likely to diffuse in Cu than Fe, it was alloyed to a Cu—Mn alloy during sintering, the alloyed Cu—Mn alloy was brought into a liquid phase state, and these elements were able to diffuse in the iron base. On the other hand, since the mass ratio of Mn/Cu of the sintered and forged members according to Comparative Examples 1 to 3 exceeded 0.25, it is thought that a melting point of the Cu—Mn alloy was higher and liquefaction became difficult. Thus, the yield ratio of the sintered and forged member is thought to have become lower than in Examples 1 to 10 because diffusion of Mn and Cu became insufficient.

In addition, as shown in FIG. 1, the yield ratio of the sintered and forged members of Examples 1 to 10 was higher than those of Comparative Examples 4 to 6. This is thought to have been caused by the fact that, since the sintered and forged member did not contain Mn in Comparative Example 4, it was not reinforced in a solid-solution state by Mn. In addition, in Comparative Example 5, as shown in FIG. 6B, Mn did not uniformly diffuse into the iron base, but segregated (monotectoid of Mn occurs). In Comparative Example 6, as shown in FIG. 6C, Mn and Si did not uniformly diffuse into the iron base, but segregated (monotectoid of Mn occurs). This is thought to be the reason for which the yield ratio of the sintered and forged members of Comparative Examples 2 and 3 was lower than that of Examples 1 to 10.

On the other hand, in Examples 1 to 10, it is thought that, since a manganese-containing powder made of Fe—Mn—C—Si containing manganese as a main component was added in place of the manganese powder to the mixed powder, during sintering, C of the manganese-containing powder prevented oxidation of Mn and Si of the manganese-containing powder lowered the viscosity of the powder. As a result, it is thought that, in Examples 1 to 10, compared to a case in which a manganese powder made of pure manganese was used as in Comparative Examples 2 and 3, Mn was more likely to diffuse into the mixed powder (specifically, Cu powder) and the Cu—Mn alloy was more likely to be produced. As a result, as shown in FIG. 6A, in the sintered and forged member as in Example 1, Mn is thought to have uniformly diffused into the iron base.

Figure 2:
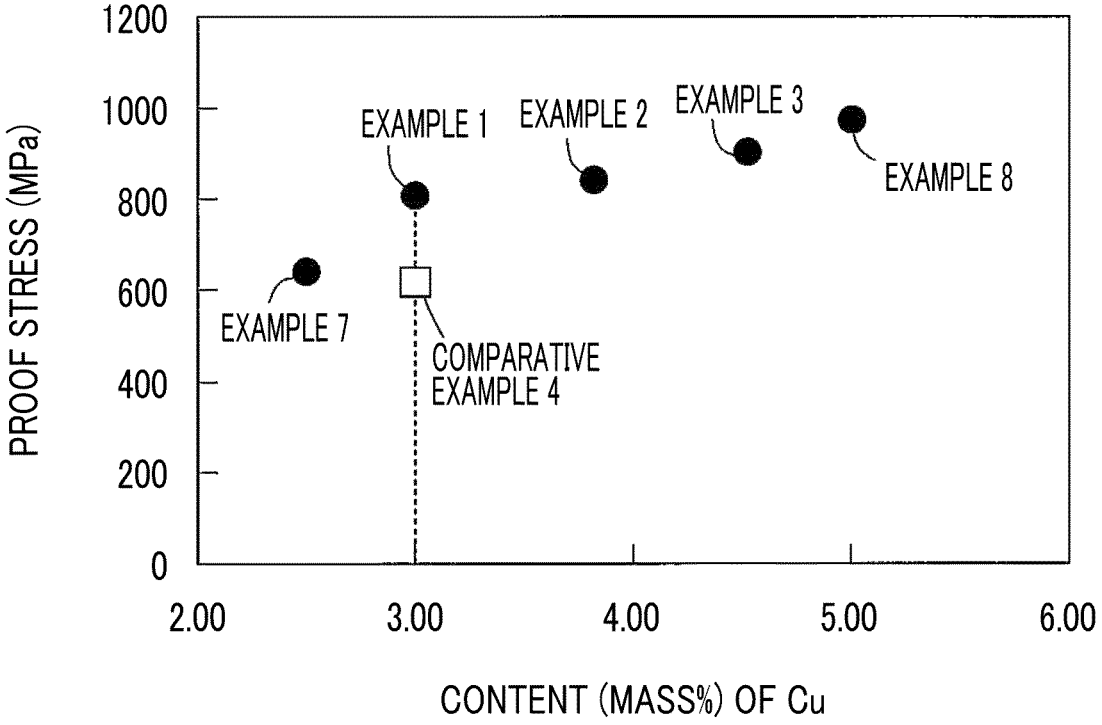
FIG. 2 is a graph showing the relationship between a content of Cu in the sintered and forged members of Examples 1 to 3, 7, and 8 and Comparative Example 4 and a proof stress thereof.

FIG. 2 is a graph showing the relationship between a content of Cu in the sintered and forged members of Examples 1 to 3, 7, and 8 and Comparative Example 4 and the proof stress thereof. As shown in FIG. 2, the proof stress of the sintered and forged member of Example 1 was higher than that of Comparative Example 4. This is because the sintered and forged member of Comparative Example 4 did not contain Mn. In addition, the proof stress of the sintered and forged members of Examples 1 to 3 and 8 was higher than that of Example 7. This is thought to have been caused by the fact that the sintered and forged members of Examples 1 to 3 and 8 contained a larger amount of Cu than that of Example 7.

Figure 3:
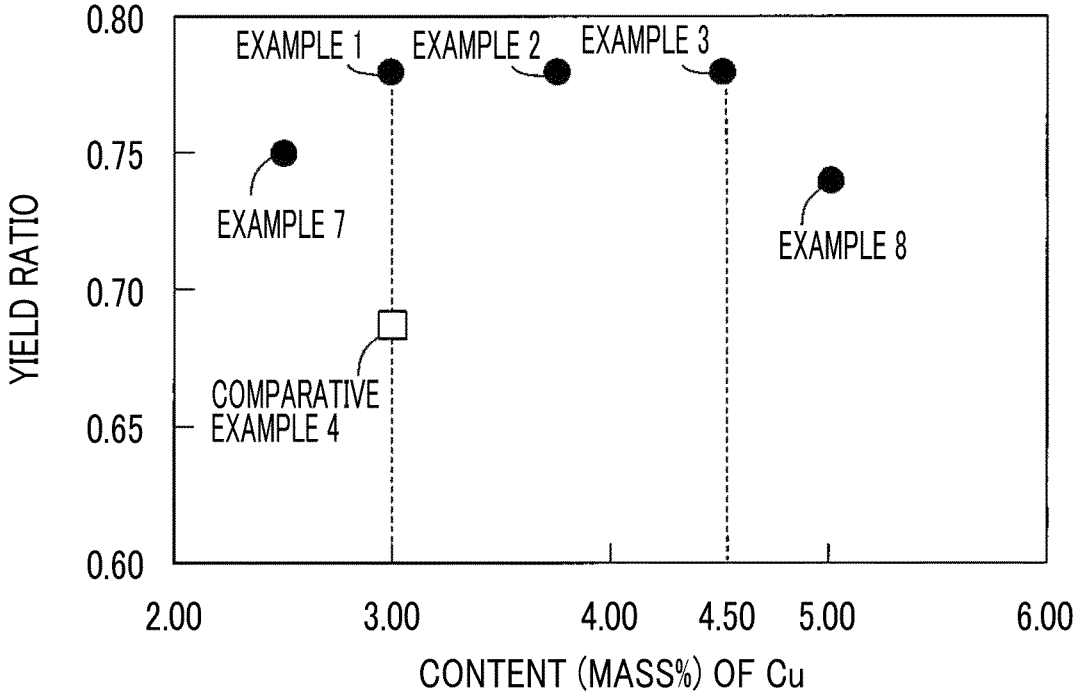
FIG. 3 is a graph showing the relationship between a content of Cu in the sintered and forged members of Examples 1 to 3, 7, and 8 and Comparative Example 4 and a yield ratio thereof.

FIG. 3 is a graph showing the relationship between a content of Cu in the sintered and forged members of Examples 1 to 3, 7, and 8 and Comparative Example 4 and the yield ratio thereof. As shown in FIG. 3, the yield ratio of the sintered and forged members of Examples 1 to 3 was higher than that of Example 8. This is thought to have been caused by the fact that, since the sintered and forged member of Example 8 contained a larger amount of Cu than those of Examples 1 to 3, Cu did not completely diffuse into the iron base, and excess Cu precipitated on the sintered and forged member.

As described above, it is thought that, when Cu (in other words, copper powder added to the mixed powder) contained in the sintered and forged member is in the range of 3.00 mass % to 4.50 mass %, it is possible to increase the proof stress of the sintered and forged member and further increase the yield ratio.

Figure 4:
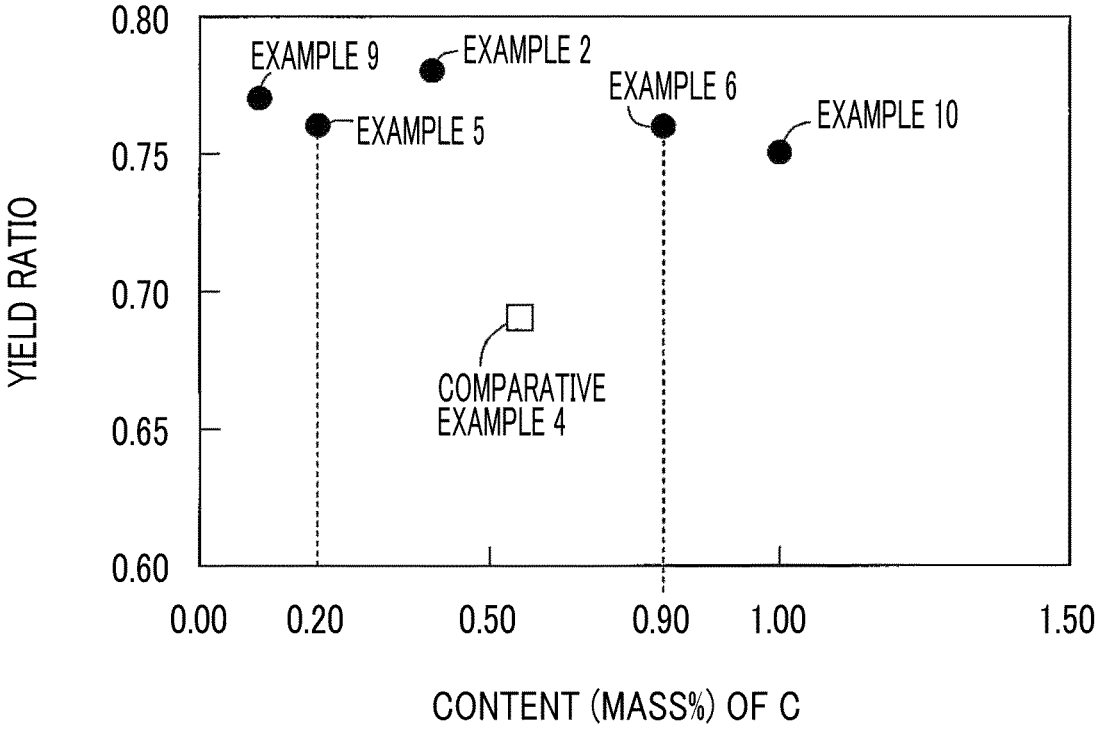
FIG. 4 is a graph showing the relationship between a content of C in the sintered and forged members of Examples 2, 5, 6, 9, and 10 and Comparative Example 4 and a yield ratio thereof.

FIG. 4 is a graph showing the relationship between a content of C in the sintered and forged members of Examples 2, 5, 6, 9, and 10 and Comparative Example 4 and the yield ratio thereof. As shown in FIG. 4, as described above, the yield ratios of the sintered and forged members of Examples 2, 5, 6, 9, and 10 were higher than that of Comparative Example 4 and were all similar.

Figure 5:
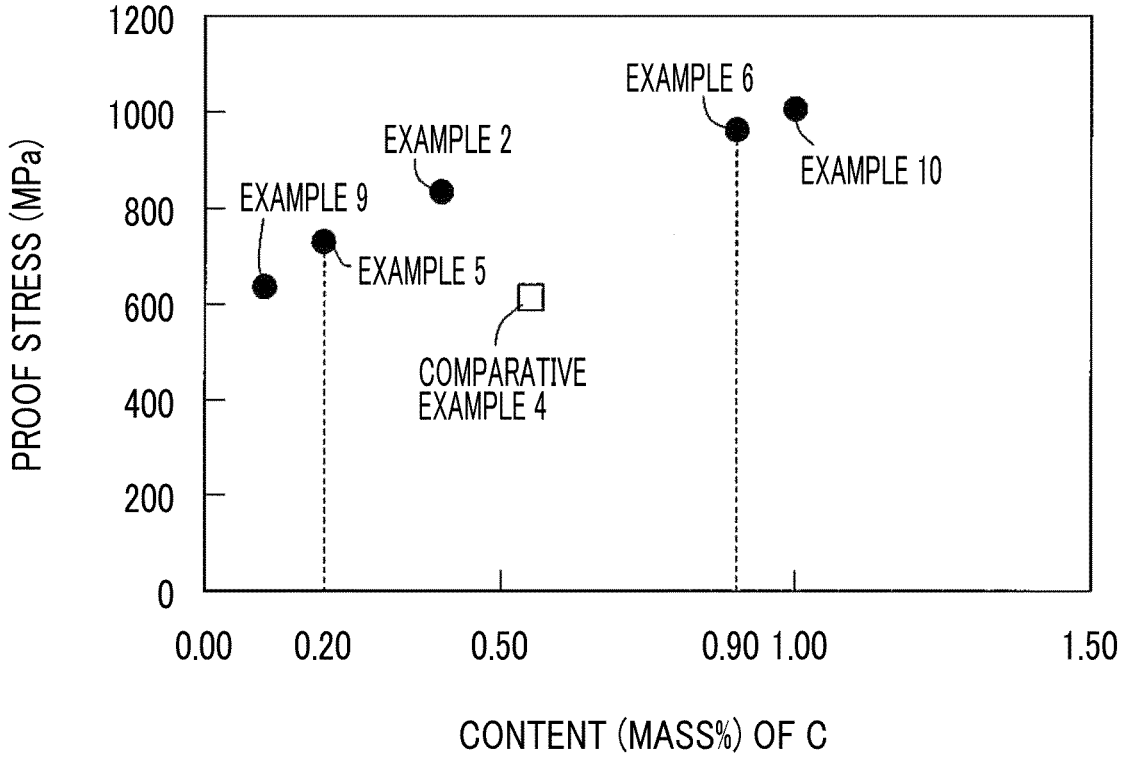
FIG. 5 is a graph showing the relationship between a content of C in the sintered and forged members of Examples 2, 5, 6, 9, and 10 and Comparative Example 4 and a proof stress thereof.

FIG. 5 is a graph showing the relationship between a content of C in the sintered and forged members of Examples 2, 5, 6, 9, and 10 and Comparative Example 4 and the proof stress thereof. As shown in FIG. 5, the proof stress of the sintered and forged members of Examples 2, 5, 6, and 10 was higher than that of Example 9. This is because the sintered and forged member of Example 9 had a smaller content of C than those of Examples 2, 5, 6, and 10. On the other hand, even if a content of C exceeded 0.9 mass %, improvement in the proof stress and yield ratio of the sintered and forged member was thought to be unlikely. This is thought to have been caused by the fact that, as an amount of C increased, there were fewer ferrite structures of the iron base of the sintered and forged member, and further diffusion of Mn and Cu into the ferrite structure was not expected.

As described above, when C (in other words, graphite powder added to the mixed powder) contained in the sintered and forged member was in the range of 0.2 mass % to 0.9 mass %, it is considered possible to increase the proof stress of the sintered and forged member and further increase the yield ratio more appropriately.

While embodiments of the present disclosure have been described above in detail, the present disclosure is not limited to the above embodiments, and various design modifications can be made.

What is claimed is:

1. A method of producing a sintered and forged member which includes 0.10 mass % to 1.00 mass % C, 2.50 mass % to 5.00 mass % Cu, 0.50 mass % to 0.75 mass % Mn, and 0.02 mass % or less Si with the balance consisting of Fe and inevitable impurities with respect to a total mass and has a mass ratio of Mn/Cu in a range of 0.10 to 0.25, comprising:

a mixing process in which a manganese-containing powder made of Fe—Mn—C—Si containing 0.2 mass % to 1.6 mass % Si and 62 mass % to 75 mass % manganese, an iron powder made of Fe, a copper powder made of Cu, and a graphite powder made of graphite are mixed together to prepare a mixed powder;

a molding process in which the mixed powder is compression-molded into a molded product;

a sintering process in which, when the molded product is heated, copper derived from the copper powder and manganese contained in the manganese-containing powder are alloyed to a copper-manganese alloy, the alloyed copper-manganese alloy is brought into a liquid phase state, and the molded product is sintered to produce a sintered product while elements of the copper-manganese alloy diffuse into an iron base of the molded product; and a process in which the sintered product is forged.

2. The method according to claim 1, wherein, in the mixing process of preparing the mixed powder, the copper powder is added so that an amount of Cu is 3.00 mass % to 4.50 mass % with respect to a total mass of the sintered and forged member.

3. The method according to claim 1, wherein, in the mixing process of preparing the mixed powder, the graphite powder is added so that an amount of C is 0.2 mass % to 0.9 mass % with respect to a total mass of the sintered and forged member.

4. The method according to claim 1, wherein the manganese-containing powder is added in the range of 0.67 mass % to 0.88 mass % with respect to a total mass of the mixed powder.

5. The method according to claim 1, wherein a yield ratio of the sintered and forged member is in the range of 0.72 to 0.78.

6. The method according to claim 1, wherein the Fe—Mn—C—Si contains 62 mass % to 70 mass % Mn.

7. A method of producing a sintered and forged member which includes 0.10 mass % to 1.00 mass % C, 2.50 mass % to 5.00 mass % Cu, 0.50 mass % to 0.75 mass % Mn, and 0.02 mass % or less Si with the balance consisting of Fe and inevitable impurities with respect to a total mass and has a mass ratio of Mn/Cu in a range of 0.10 to 0.25, comprising:

a mixing process in which a manganese-containing powder made of Fe—Mn—C—Si containing manganese as a main component, an iron powder made of Fe, a copper powder made of Cu, and a graphite powder made of graphite are mixed together to prepare a mixed powder, wherein the Fe—Mn—C—Si includes 62 mass % to 75 mass % Mn, 0.4 mass % to 1.8 mass % C, and 0.2 mass % to 1.6 mass % Si with the balance consisting of Fe and inevitable impurities;

a molding process in which the mixed powder is compression-molded into a molded product;

a sintering process in which, when the molded product is heated, copper derived from the copper powder and manganese contained in the manganese-containing powder are alloyed to a copper-manganese alloy, the alloyed copper-manganese alloy is brought into a liquid phase state, and the molded product is sintered to produce a sintered product while elements of the copper-manganese alloy diffuse into an iron base of the molded product; and a process in which the sintered product is forged.

8. The method according to claim 7, wherein the manganese-containing powder is added in the range of 0.67 mass % to 0.88 mass % with respect to a total mass of the mixed powder.

9. The method according to claim 7, wherein a yield ratio of the sintered and forged member is in the range of 0.72 to 0.78.

10. The method according to claim 7, wherein the Fe—Mn—C—Si contains 62 mass % to 70 mass % Mn.

11. A method of producing a sintered and forged member which includes 0.10 mass % to 1.00 mass % C, 2.50 mass % to 5.00 mass % Cu, 0.50 mass % to 0.75 mass % Mn, and 0.02 mass % or less Si with the balance consisting of Fe and inevitable impurities with respect to a total mass and has a mass ratio of Mn/Cu in a range of 0.10 to 0.25, comprising:

a mixing process in which a manganese-containing powder made of Fe—Mn—C—Si containing 62 mass % to 75 mass % manganese, an iron powder made of Fe, a copper powder made of Cu, and a graphite powder made of graphite are mixed together to prepare a mixed powder, wherein the manganese-containing powder is added in a range of 0.67 mass % to 0.88 mass % with respect to a total mass of the mixed powder;

a molding process in which the mixed powder is compression-molded into a molded product;

a sintering process in which, when the molded product is heated, copper derived from the copper powder and manganese contained in the manganese-containing powder are alloyed to a copper-manganese alloy, the alloyed copper-manganese alloy is brought into a liquid phase state, and the molded product is sintered to produce a sintered product while elements of the copper-manganese alloy diffuse into an iron base of the molded product; and a process in which the sintered product is forged.

12. The method according to claim 11, wherein the manganese-containing powder is added in the range of 0.67 mass % to 0.74 mass % with respect to the total mass of the mixed powder.

13. The method according to claim 11, wherein a yield ratio of the sintered and forged member is in the range of 0.72 to 0.78.

14. The method according to claim 11, wherein the Fe—Mn—C—Si contains 62 mass % to 70 mass % Mn.

* * * * *